US006379120B1

(12) United States Patent
Adaniya et al.

(10) Patent No.: US 6,379,120 B1
(45) Date of Patent: Apr. 30, 2002

(54) VARIABLE-DISPLACEMENT COMPRESSOR

(75) Inventors: Taku Adaniya; Ryo Matsubara; Tomoji Tarutani; Masaki Ota, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 22 days.

(21) Appl. No.: 09/670,135

(22) Filed: Sep. 26, 2000

(30) Foreign Application Priority Data

Oct. 8, 1999 (JP) ..... 11-288124

(51) Int. Cl.[7] ..... F04B 1/26
(52) U.S. Cl. ..... 417/222.1; 91/505; 92/76
(58) Field of Search ..... 417/222.2, 218, 417/269; 92/68, 76; 91/472, 504, 505

(56) References Cited

U.S. PATENT DOCUMENTS 6,158,970 A * 12/2000 Ota et al. ..... 137/50
6,213,728 B1 * 4/2001 Kato et al. ..... 417/222.2
6,217,291 B1 * 4/2001 Ota et al. ..... 417/222.2
6,220,146 B1 * 4/2001 Ota et al. ..... 417/222.1

* cited by examiner

*Primary Examiner*—Teresa Walberg
*Assistant Examiner*—Thor Campbell
(74) *Attorney, Agent, or Firm*—Woodcock Washburn LLP

(57) ABSTRACT

A swash plate 20 made of an aluminum-based material is allowed to be inclined in the axial direction of a rotary shaft 18 and to rotate integrally with the rotary shaft 18 due to the engagement between guide holes 251 formed in the support arms 25 made of an iron-based material and heads 231 of to-be-guided pins 23 made of an iron-based material. The inclination of the swash plate 20 is guided based upon a slide guide relationship between the guide holes 251 and the to-be-guided pins 23 and upon a slide support action of the rotary shaft 18. The inclination-limiting protuberances 191 integrally formed on the rotary support member 19 made of the iron-based material come into contact with the to-be-guided pins 23. The swash plate 20 is inclined at a maximum angle in a state where the inclination-limiting protuberances 191 come into contact with the to-be-guided pins 23.

10 Claims, 11 Drawing Sheets

VARIABLE-DISPLACEMENT COMPRESSOR

BACKGROUND OF THE INVENTION

1. Field of the Invention

The present invention relates to a variable-displacement compressor comprising a swash plate contained in a control pressure chamber so as to rotate integrally with a rotary shaft and to be inclined relative to the rotary shaft, plural pistons arranged about the rotary shaft and reciprocally moving depending upon the inclination of the swash plate, and swash plate inclination guide means for guiding the inclination of the swash plate, wherein the pressure in the control pressure chamber is controlled to control the inclination of the swash plate.

2. Description of the Related Art

In the variable-displacement compressors of this type disclosed in Japanese Unexamined Patent Publications (Kokai) No. 10-246181 and No. 11-201032, the angle of inclination of a swash plate decreases with an increase in the pressure in the crank chamber (control pressure chamber referred to in this specification) and the discharge capacity decreases. On the other hand, the angle of inclination of the swash plate increases with a decrease in the pressure in the crank chamber, and the discharge capacity increases. In the variable-displacement compressor which controls:.the capacity based on the adjusted pressure in the crank chamber, on the other hand, a maximum angle of inclination of the swash plate is determined by a rotary support member which rotates integrally with the rotary shaft and supports the swash plate via a hinge mechanism upon- receiving the inclination of the swash plate.

The swash plate is made of aluminum from the standpoint of reducing the weight. However, direct contact between the rotary support member made of iron and the swash plate made of aluminum causes wear at the contact portion of the swash plate. The contact portion of the swash plate that is worn out causes a change in the maximum angle of inclination of the swash plate. In the compressors disclosed in Japanese Unexamined Patent Publications (Kokai) No. 10-246181 and No. 11-201032, a weight made of iron is attached to the swash plate so that the weight made of iron comes in contact with the rotary support member. The constitution in which iron comes into contact with iron prevents wear, and a change in the maximum angle of inclination of the swash plate does not occur.

The weight is used for stably controlling the capacity. However, the weight distribution of the weight for stably controlling the capacity is affected by the shape of the weight. It is difficult to determine the shape of the weight for specifying a maximum angle of inclination of the swash plate in consideration for a suitable shape of the weight that greatly affects the operation for stably controlling the-capacity.

SUMMARY OF THE INVENTION

It is an object of the present invention to easily determine the maximum angle of inclination of a swash plate without causing a change in the maximum angle of inclination that results from a wear.

In order to accomplish the above-mentioned object, the present invention deals with a variable-displacement compressor comprising a swash plate contained in a control pressure chamber so as to rotate integrally with a rotary shaft and to be inclined relative to the rotary shaft, plural pistons arranged about the rotary shaft and reciprocally moving depending upon the inclination of the swash plate, and swash plate inclination guide means for guiding the inclination of the swash plate, the pressure in the control pressure chamber being controlled to control the inclination of the swash plate, wherein the swash plate inclination guide means includes a guide member having a passage-limiting cam, and to-be-guided members that are guided in slide contact with the passage-limiting cam, the guide member is formed integrally with the rotary shaft, the to-be-guided members are formed integrally with the swash plate, and a maximum inclination angle determining means is provided to set the swash plate at a position at where the angle of inclination of the swash plate becomes a maximum due to the contact of the guide member with the to-be-guided members.

The constitution for determining a maximum angle of inclination of the swash plate, based on the contact of the guide member constituting the swash plate inclination guide means with the to-be-guided members, is such that the guide member and the to-be-guided members are made of an iron-type material, and that the maximum angle of inclination is easily set while being free from being changed by the wear.

The present invention may be more fully understood from the description of the preferred embodiments of the invention set forth below together with the accompanying drawings.

DESCRIPTION OF THE PREFERRED EMBODIMENTS

The compressor according to a first embodiment of the invention will now be described with reference to FIGS. 1 to 5.

Figure 1:
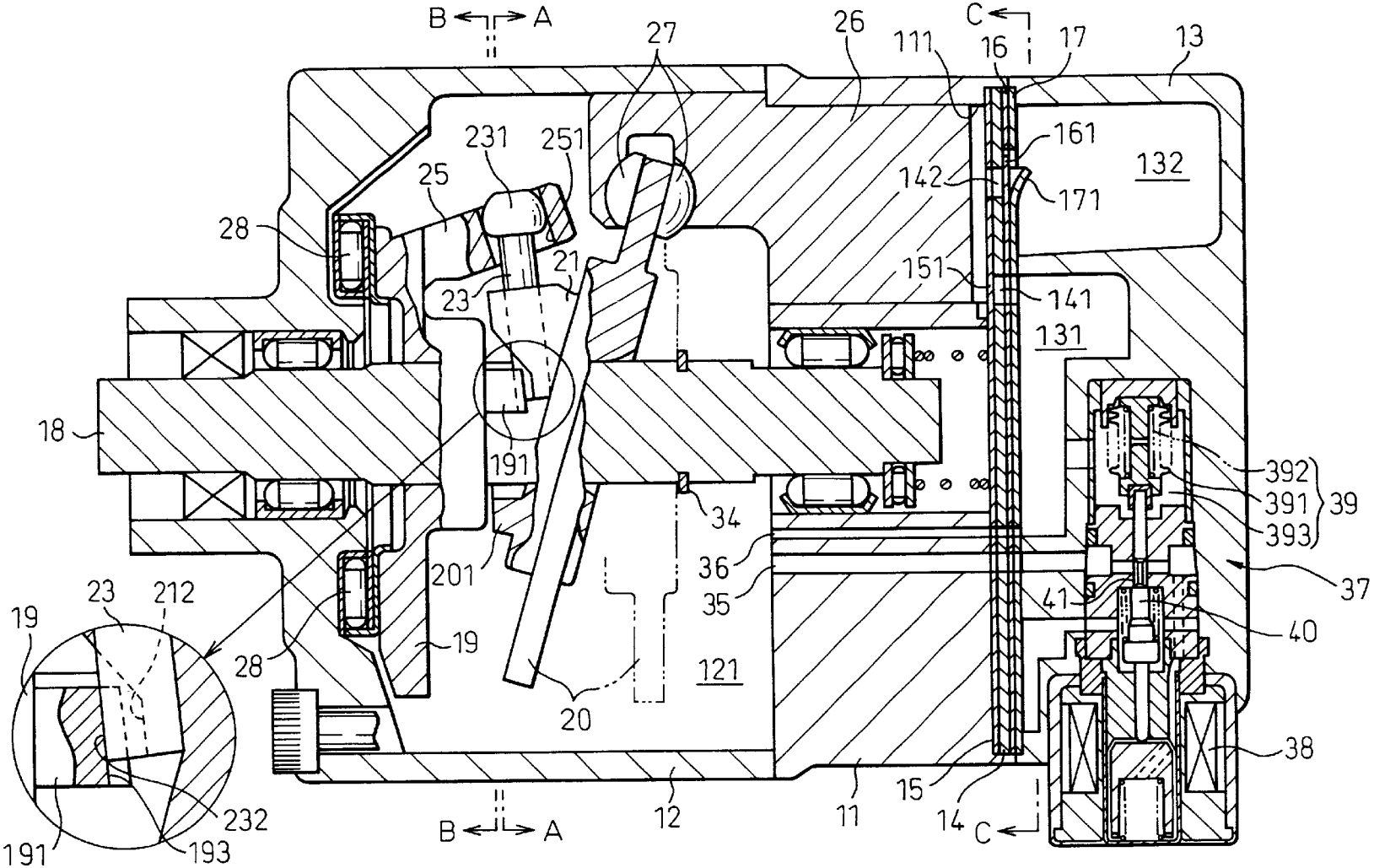
FIG. 1 is a side sectional view of a whole compressor according to a first embodiment of the present invention, the view illustrating major portions on an enlarged scale.

Referring to FIG. 1, a front housing 12 is joined to a front end of a cylinder block 11. To the rear end of the cylinder block 11 is joined and secured a rear housing 13 via a valve plate 14, valve-forming plates 15 and 16, and a retainer-forming plate 17. A rotary shaft 18 is rotatably supported by the front housing 12 and by the cylinder block 11 which together form a control pressure chamber 121. A rotary shaft 18 protruding outward from the control pressure chamber 121 receives a drive force from an external drive source such as a vehicle engine (not shown) through a pulley (not shown) and a belt (not shown).

Figure 3:
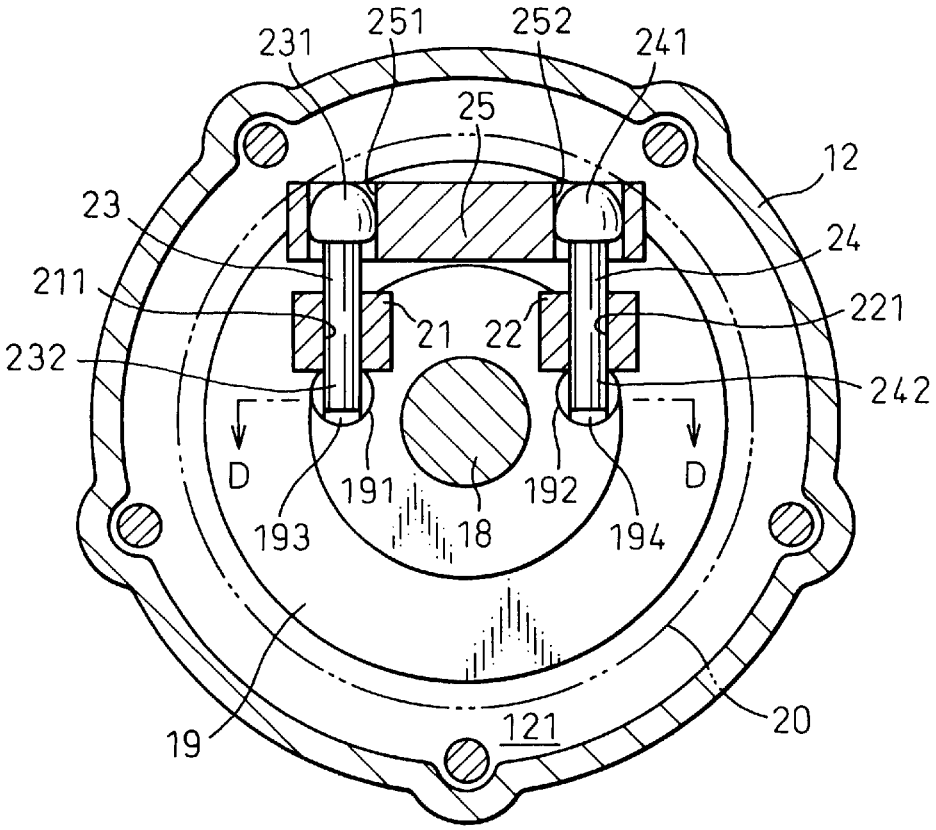
FIG. 3 is a sectional view along the line B—B of FIG. 1.

A rotary support member 19 made of an iron-based material is fastened to the rotary shaft 18. Further, a swash plate 20 made of an aluminum-based material containing silicon is supported by the rotary shaft 18 and is allowed to slide in the axial direction thereof and is allowed to be inclined. Referring to FIG. 3, the swash plate 20 has coupling pieces 21, 22 of a cylindrical shape integrally formed therewith. To-be-guided pins 23 and 24 made of an iron-based material are forcibly introduced and fastened into support holes 211 and 221 of the coupling pieces 21 and 22. The to-be-guided pins 23 and 24 are in parallel as viewed in the axial direction of the rotary shaft 18, and are symmetrical on a plane inclusive of the rotary shaft 18. The rotary support member 19 has a support arm 25 integrally formed therewith, and the support arm 25 has a pair of guide holes 251 and 252 formed therein.

Figure 2:
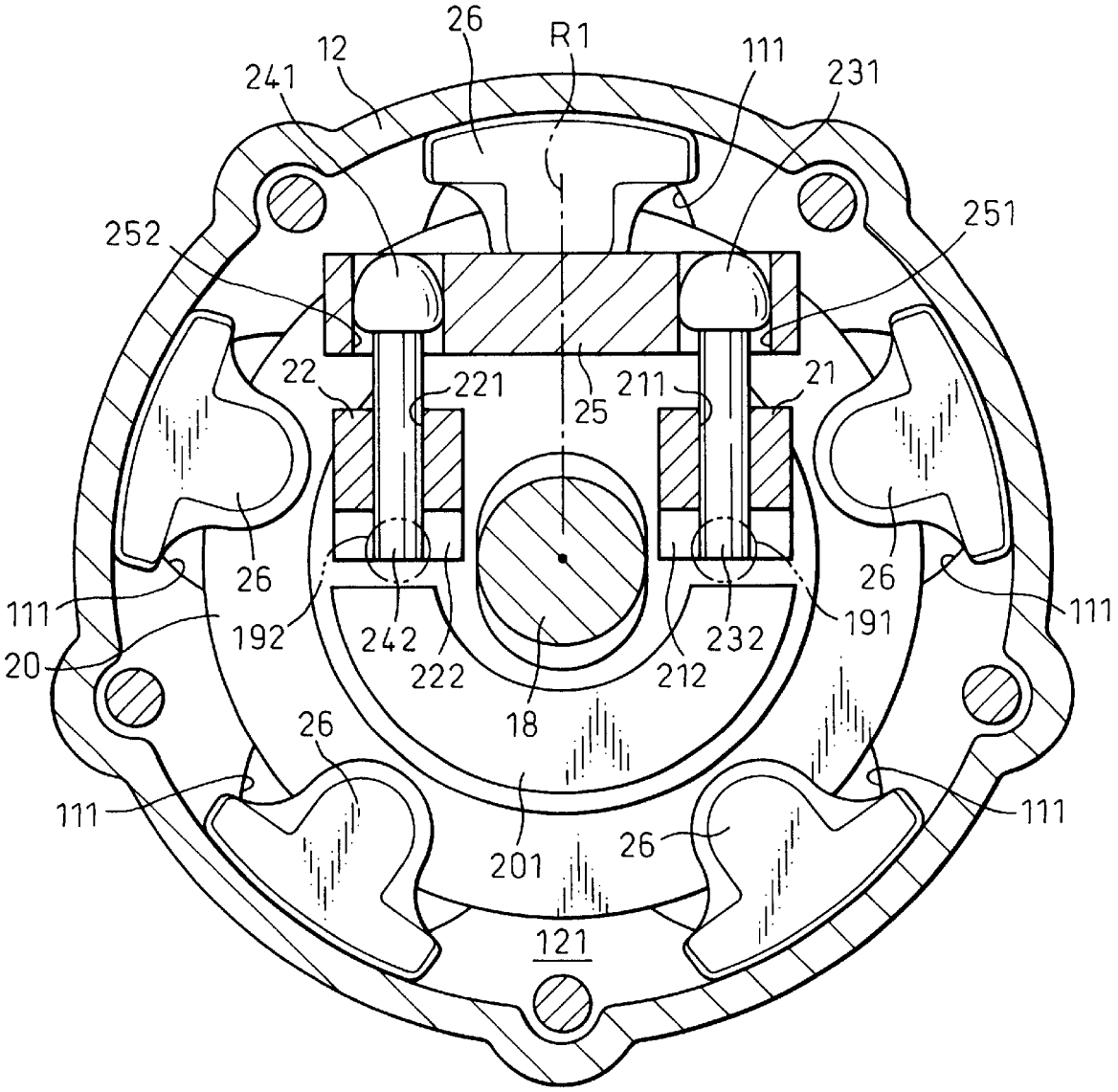
FIG. 2 is a sectional view along the line A—A of FIG. 1.

Referring to FIG. 2, the guide holes 251 and 252 are in parallel with each other as viewed in the axial direction of the rotary shaft 18. Further, the guide holes 251 and 252 are in parallel with respect to a radial line R1 of the rotary shaft 18 as viewed in the axial direction of the rotary shaft 18 and are symmetrical on the right and left sides of the radial line R1. Spherical head portions 231 and 241 of the to-be-guided pins 23 and 24 are slidably fitted into the guide holes 251 and 252. Due to the engagement between the guide holes 251, 252 and the pair of head portions 231, 241, the swash plate 20 is allowed to incline in the axial direction of the rotary shaft 18 and to rotate integrally with the rotary shaft 18. The inclination of the swash plate 20 is guided based upon a slide guide relationship between the guide holes 251, 252 and the to-be-guided pins 23, 24 and upon the slide-support action of the rotary shaft 18. The rotary support member 19, the support arm 25 that works as a passage-limiting cam, guide holes 251, 252 and to-be-guided:pins 23, 24, constitute a hinge mechanism for inclining the swash plate 20. The hinge mechanism is a swash plate inclination guide means.

When the center of radius of the swash plate 20 moves toward the side of the rotary support member 19, the angle of inclination of the swash plate 20 increases. When the center of radius of the swash plate 20 moves toward the side of the cylinder block 11, the angle of inclination of the swash plate 20 decreases. A minimum angle of inclination of the swash plate 20 is determined by the contact of a circular clip 34 attached to the rotary shaft 18 with the swash plate 20. A position of the swash plate 20 indicated by a chain line in FIG. 1 is a position where the angle of inclination of the swash plate 20 becomes a minimum.

Figure 5:
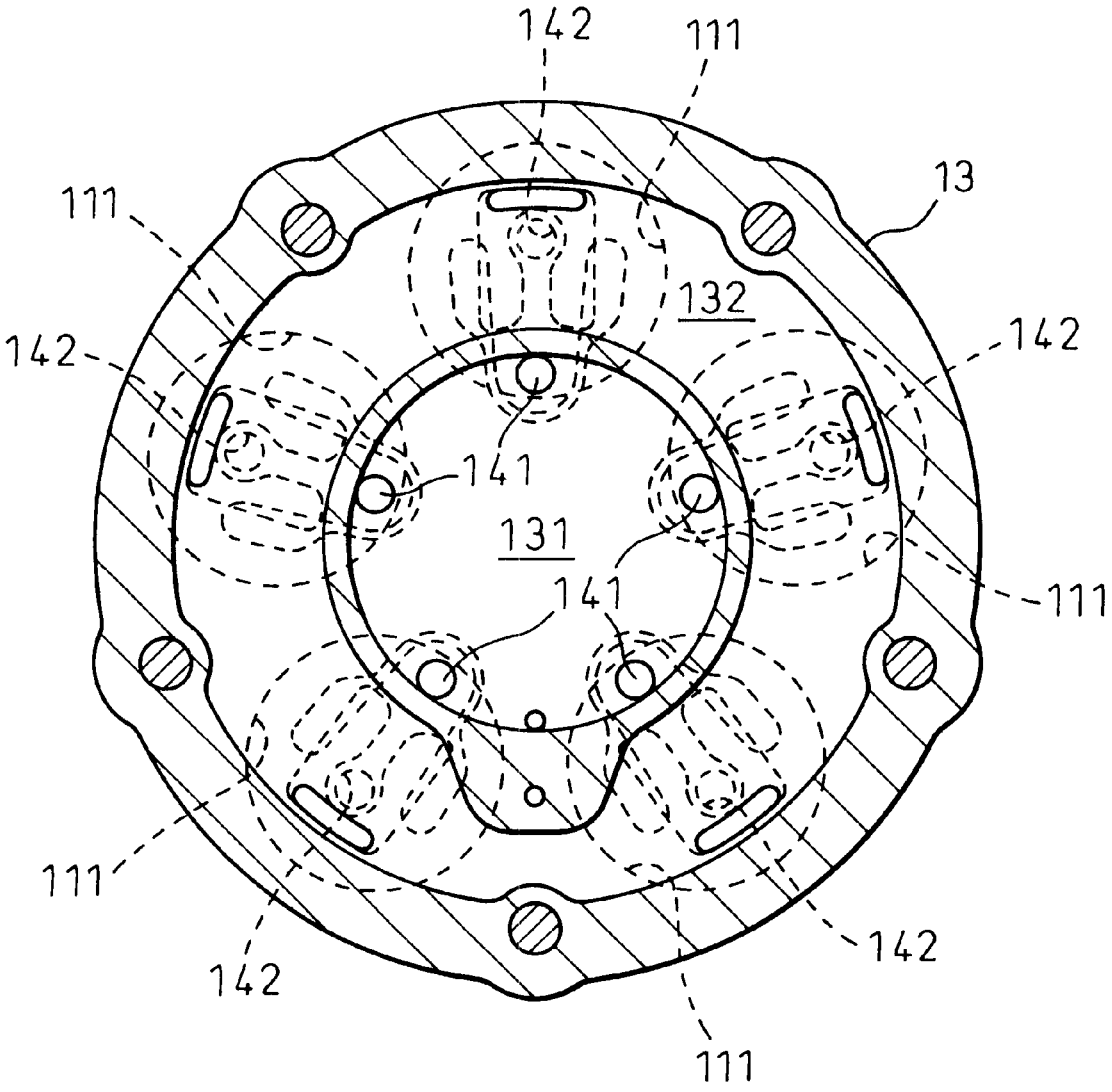
FIG. 5 is a sectional view along the line C—C of FIG. 1.

Referring to FIGS. 2 and 5, plural cylinder bores 111 (five bores in this embodiment) are perforated in the cylinder block 11. The plural cylinder bores 111 surround the rotary shaft 18 at an equal distance, and a piston 26 is contained in each cylinder bore 111. The rotating movement of the swash plate 20 is converted into a back-and-force reciprocating movement of the piston via a shoe 27, and the piston 26 moves back and forth in the cylinder bore 111.

Referring to FIGS. 1 and 5, a suction chamber 131 and a discharge chamber 132 are defined in the rear housing 13. A suction port 141 is formed on the valve plate 14, on the valve-forming plate 16 and on the retainer-forming plate 17, and a discharge port 142 is formed on the valve plate 14 and on the valve-forming plate 15. A suction valve 151 is formed on the valve-forming plate 15, and a discharge valve 161 is formed on the valve-forming plate 16. Due to the reciprocating movement of the piston 26, a refrigerant gas in the suction chamber 131 flows into the cylinder bore 111 through the suction port 141 after pushing back the suction valve 151. The refrigerant gas that has flowed into the cylinder bore 111 is discharged into the discharge chamber 132 through the discharge port 142 after pushing back the discharge valve 161 due to the reciprocating movement of the piston 26. The discharge valve 161 comes into contact with the retainer 171 on the retainer-forming plate 17 and is limited in its opening degree. The refrigerant discharged into the discharge chamber 132 refluxes into the suction chamber 131 passing through an external refrigerating circuit (not shown) on the outside of the compressor.

The discharge chamber 132 and the control pressure chamber 121 are connected together through a pressure supply passage 35, and the control pressure chamber 121 and the suction chamber 131 are connected together through a pressure release passage 36 having a throttle action. An electromagnetic capacity control valve 37 is interposed in the pressure supply passage 35. The pressure supply passage 35 feeds the refrigerant in the discharge chamber 132 into the pressure control chamber 121. A solenoid 38 of the capacity control valve 37 is energized and de-energized by a controller (not shown). That is, the capacity control valve 37 is energized and de-energized by the controller based upon a temperature detected by a compartment temperature detector (not shown) that detects the temperature in the compartment of the vehicle and based upon a target compartment temperature set by a compartment temperature setter (not shown).

The pressure (suction pressure) in the suction chamber 131 acts upon a bellows 391 that constitutes pressure-sensing means 39 in the capacity control valve 37 via a pressure-sensing chamber 393. The suction pressure in the suction chamber 131 is reflecting the thermal load. A valve body 40 is connected to the bellows 391 to open and close a valve port 41. The atmospheric pressure in the bellows 391 and the resilient force of a pressure-sensing spring 392 constituting the pressure-sensing means 39 act upon the valve body 40 in a direction in which the valve port 41 is opened. The electromagnetic drive force of the solenoid 38 urges the valve body 40 in a direction in which the valve port 41 is closed. The capacity control valve 37 works so as to bring about a suction pressure corresponding to the current supplied to the solenoid 38.

The refrigerant in the discharge chamber 132 is supplied to the control pressure chamber 121 through the valve port 41 and pressure supply passage 35. The opening degree of the valve decreases with an increase in the current supplied to the solenoid 38 and, hence, the refrigerant is supplied in a decreased amount from the discharge chamber into the control pressure chamber 121. The refrigerant in the control pressure chamber 121 flows into the suction chamber 131 through the pressure release passage 36 and, hence, the pressure in the control pressure chamber 121 decreases. Accordingly, the angle of inclination of the swash plate 20 increases and the discharge amount increases. An increase in the discharge amount results in a decrease in the suction pressure. When the electric current is supplied in a decreased amount, the opening degree of the valve increases and, hence, the refrigerant is supplied in an increased amount from the discharge chamber 132 into the control pressure chamber 121. Therefore, the pressure in the control pressure chamber 121 increases, the angle of inclination of the swash plate 20 decreases, and the discharge amount decreases. A decrease in the discharge capacity results in an increase in the suction pressure.

A pair of inclination-limiting protuberances 191 and 192 are integrally formed on the surface of the rotary support member 19 facing the swash plate, 20. A U-shaped weight 201 is integrally formed on the surface of the swash plate 20 facing the rotary support member 19. Due to the centrifugal force produced by the rotation of the swash plate 20, the weight 201 urges the swash plate 2 in a direction in which the angle of inclination of the swash plate 20 decreases.

Figure 4:
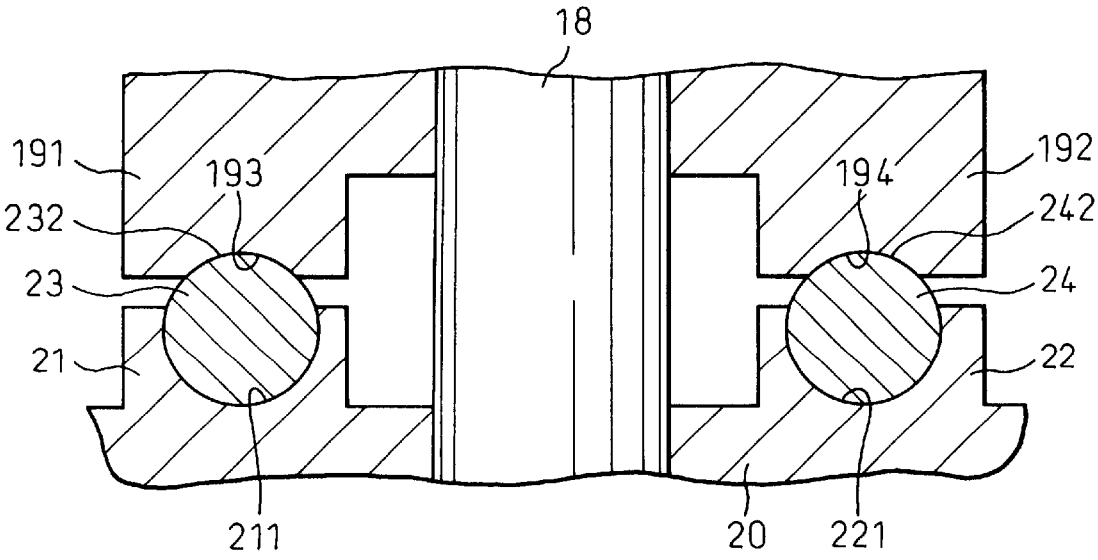
FIG. 4 is a sectional view along the line D—D of FIG. 3.

Open portions 212, 222 are formed by the sides of the support holes 211 and 221 in the coupling pieces 21 and 22. The open portions 212 and 222 are on the lower side of the coupling pieces 21 and 22, opposite to the side of the rotary support member 19. Peripheral surfaces 232 and 242 on the lower end side of the to-be-guided pins 23 and 24 are exposed through the open portions 212 and 222. Referring to FIGS. 3 and 4, position-limiting surfaces 193 and 194 of an arcuate shape are formed at the ends of the inclination-limiting protuberances 191 and 192, and are allowed to come into surface contact with the exposed peripheral surfaces 232 and 242 of the to-be-guided pins 23 and: 24. In a state where the exposed peripheral surfaces 232 and 242 are in contact with the position-limiting surfaces 193 and 194, the swash plate 20 is inclined at a maximum angle. The position of the swash plate 20 indicated by a solid line in FIG. 1 is the one at where the angle,of inclination becomes a maximum. The inclination-limiting protuberances 191, 192 and the exposed peripheral surfaces 232, 242 of the to-be-guided pins 23, 24, constitute a maximum inclination angle-determining means.

A thrust bearing 28 is interposed between the rotary support member 19 which serves as a guide member and the front housing 12. The thrust bearing 28 receives the compressive reaction acting on the rotary support member 19 from the cylinder bore 111 via the piston 26, shoe 27, swash plate 20, coupling pieces 21 and 22, and to-be-guided pins 23 and 24.

The first embodiment exhibits the following effects:

(1-1) When the angle of inclination of the swash plate 20 is a maximum, the exposed peripheral surfaces 232 and 242 of the to-be-guided pins 22and 24 that are to be guided, are in contact with the position-limiting surfaces 193 and 194 of the inclination limiting protuberances 191 and 192. The contact between the inclination-limiting protuberances 191, 192 which are portions of the rotary support member 19 made of a wear-resistant iron-based material and the to-be-guided pins 23, 24 made of a wear-resistant iron-based material, prevents the wear of the swash plate 20 made of an aluminum-based material having a wear resistance smaller than that of the iron-based material. This avoids the problem of a change in the maximum angle of inclination of the swash plate 20 caused by wear.

(1-2) When the inclination of the to-be-guided pins 23 and 24 is determined relative to the swash plate 20, the positions of the position-limiting surfaces 193 and 194 of the inclination-limiting protuberances 191 and 192 are inevitably determined to bring about a desired maximum angle of inclination of the swash plate 20. Therefore, the constitution in which the to-be-guided pins 23, 24 made of an iron-based material are brought into contact with the inclination-limiting protuberances 191, 192 which are portions of the rotary support member 19 made of an iron-based material to establish the state of a maximum angle of inclination, facilitates the design for determining the maximum angle of inclination of the swash plate 20.

(1-3) The to-be-guided pins 23 and 24 are forcibly introduced into the support holes 211 and 221 so as to be integral with the swash plate 20. The constitution is simple due to the forcible insertion of the to-be-guided pins 23 and 24 in the cylindrical coupling pieces 21 and 22 which are portions of the swash plate 20.

(1-4) When the open portions 212 and 222 are not formed in the coupling pieces 21 and 22, the lower ends of the to-be-guided pins 23 and 24 must be extended beyond the coupling pieces 21 and 22 to come into contact with the inclination-limiting protuberances 191 and 192. The to-be-guided pins 23 and 24 that are elongated result in an increase in the weight on the side of the swash plate 20 that rotates and inclines. An increase in the weight on this side of the swash plate 20 is not desirable from the standpoint of smoothly inclining the swash plate 20. The constitution for exposing the to-be-guided pins 23 and 24 through the open portions 212 and 222, prevents the to-be-guided pins 23, 24 forcibly inserted in the support holes 211, 221 from becoming elongated, and contributes to smoothly inclining the swash plate 20.

(1-5) The pair of to-be-guided pins 23 and 24 symmetrically arranged with the rotary shaft 18 sandwiched therebetween and in parallel with each other, receive the guiding action of the pair of parallel support holes 211 and 221. The guiding action based on the engagement of the pair of to-be-guided pins 23, 24 with the pair of support holes 211, 221, is advantageous for smoothly inclining the swash plate 20 compared with the guiding action based on the engagement of a single to-be-guided pin and a single support hole.

(1-6) The exposed peripheral surfaces 232 and 242 come into surface contact with the position-limiting surfaces 193 and 194 of the inclination-limiting protuberances 191 and 192. The surface contact for limiting the swash plate 20 at a position of a maximum angle of inclination, is effective in suppressing the wear at a portion where the inclination.-limiting protuberances 191, 192 which are portions of the-guide member come into contact with the to-be-guided pins 23 and 24.

(1-7) The swash plate 20 made of an aluminum-based material is best suited for reducing the weight of the compressor and for smoothly inclining the swash plate 20.

(1-8) The rotational force of the rotary shaft 18 is transmitted to the swash plate 20 via the rotary support member 19 which is a guide member and the to-be-guided pins 23 and 24. The swash plate 20 receives a compressive reaction and a frictional reaction due to friction relative to the shoe 27. Therefore, a large rotational force is required for rotating the swash plate while receiving these reactions. This large rotational force is transmitted through the engagement between the support arm 25 which is a portion of the rotary support member 19 and the to-be guided pins 23, 24. Therefore, the rotary support member 19 and the to-be-guided pins 23 and 24 must be made of a material having a large rigidity. The constitution is advantageous for transmitting the rotational force of the rotary shaft 18 to the swash plate 20 when the rotary support member 19 which is a guide member is made of an iron-based material and the to-be-guided pins 23 and 24 which are to be guided are made of an iron-based material.

(1-9) The maximum angle of inclination of the swash plate 20 can be changed by changing the amount of protrusion of the inclination-limiting protuberances 191 and 192 beyond the rotary support member 19, and compressors having different maximum angles of inclination can be manufactured without changing the shape of the swash plate 20.

(1-10) The to-be-guided pins 23 and 24 are mounted by being forcibly inserted in the coupling pieces 21 and 22. The forcible insertion for mounting the to-be-guided pins 23 and 24 on the swash plate 20 is easy.

(1-11) The to-be-guided pins 23 and 24 are forcibly inserted at positions between the positions where the to-be-guided pins 23, 24 come into contact with the support arm 25 which is a portion of the guide member and the positions for defining a maximum angle of inclination of the swash plate 20 (i.e., positions where the inclination-limiting protuberances 191 and 192 come into contact with the-to-be-guided pins 23 and 24). With the positions being thus set, the least load is exerted by the compressive reaction that acts on the forcibly inserted position between the above-mentioned two positions. Accordingly, the constitution in which the positions are thus set is effective in decreasing the load exerted on the position where the to-be-guided pins 23 and 24 are forcibly inserted at the moment when the swash plate 20 is inclined at a maximum angle of inclination and when the compressive reaction becomes great.

Figure 6:
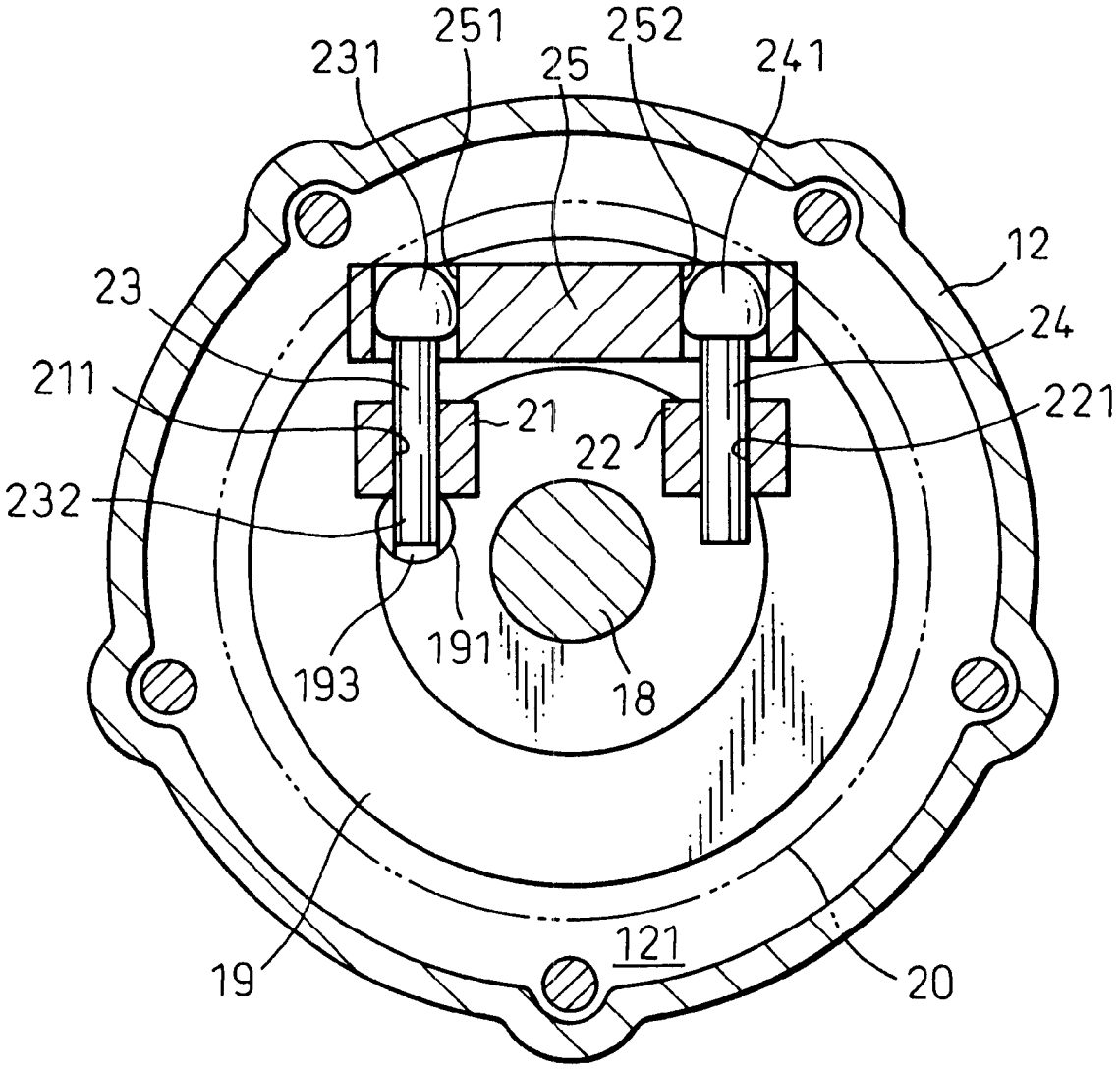
FIG. 6 is a vertical sectional view illustrating the compressor according to a second embodiment of the present invention, along the line B—B like in FIG. 3.

Next, a second embodiment will be described with reference to FIGS. 6 and 7. The same constituent portions as those of the first embodiment are denoted by the same reference numerals.

Figure 7:
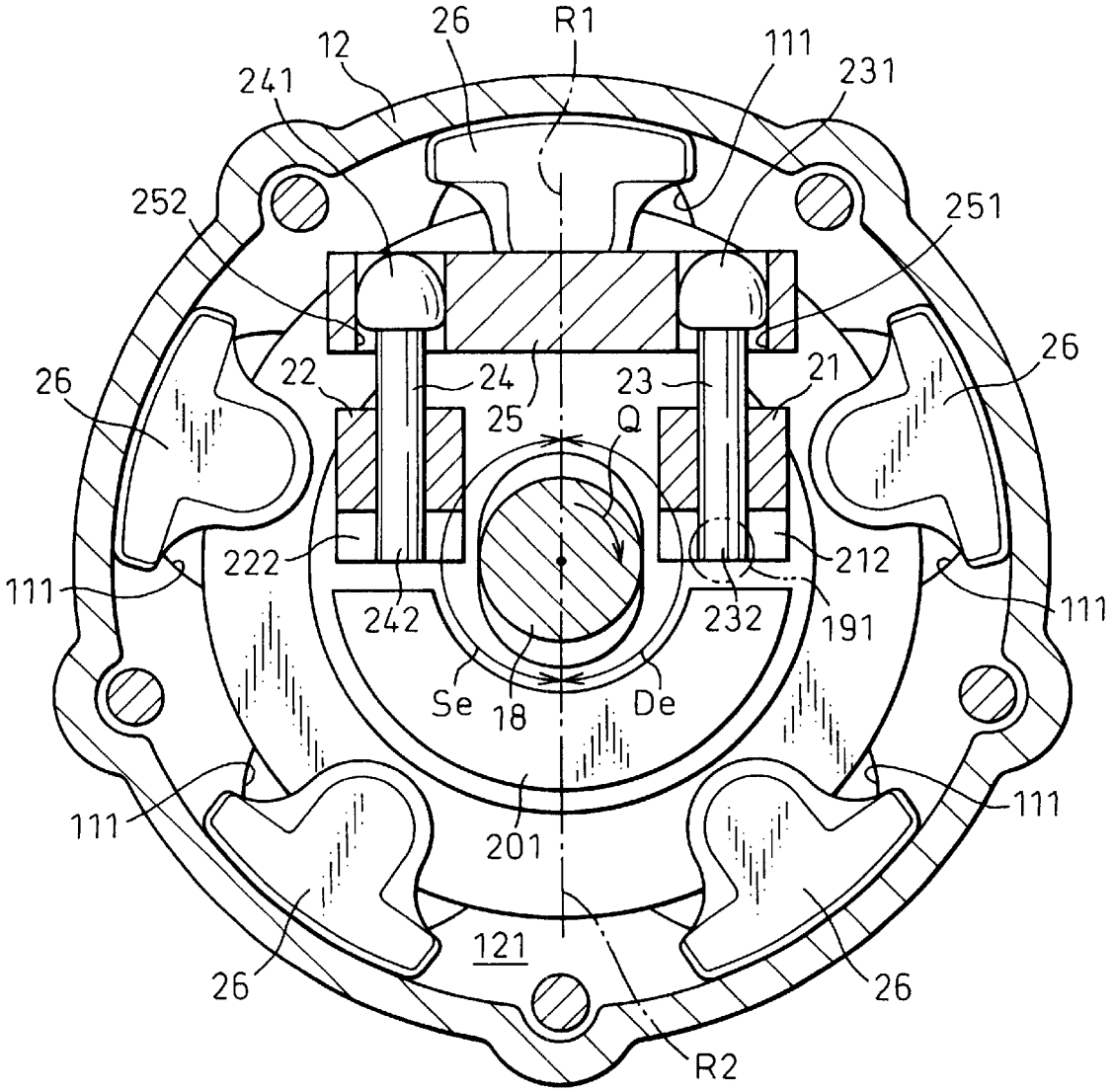
FIG. 7 is a vertical sectional view illustrating the compressor according to the second embodiment of the present invention, along the line A—A like in FIG. 2.

Referring to FIG. 7, the rotary shaft 18 rotates in the direction of an arrow Q. The guide holes 251 and 252 are in parallel with the radial line R1 of the rotary shaft 18 as viewed in the axial direction of the rotary shaft 18, and are symmetrical relative to the radial line R1, Hence, the head portions 231 and 241 of the to-be-guided pins 23 and 24 move in parallel along the guide holes 251 and 252 as viewed in the axial direction of the rotary shaft 18. In the case of FIG. 7, therefore, the two pistons 26 on the right side of the radial lines R1, R2, move from the side of the bottom dead center toward the side of the top dead center accompanying the rotation of the swash plate 20 so as to discharge the refrigerant gas from the cylinder bores 111 into the discharge chambers 132. That is, the two pistons 26 on the right side of the radial lines R1, R2 are in the discharge stroke. The two pistons 26 on the left side of the radial lines R1, R2 move from the side of the top dead center toward the side of the bottom dead center accompanying the rotation of the swash plate 20 so as to take the refrigerant gas into the cylinder bores 111 from the suction chambers 131. That is, the two pistons 26 on the left side of the radial lines R1, R2 are in the suction stroke. When the center of radius of the cylinder bore 111 is on the radial line R1, the piston 26 in the cylinder bore 111 is at the top dead center. When the center of radius of the cylinder bore 111 is on the radial line R2, the piston 26 in the cylinder bore 111 is at the bottom dead center.

In the present invention, the range (denoted by De in FIG. 7) on the swash plate 20 from the radial line R1 to the radial line R2 concerning the rotational direction Q of the rotary shaft 18, is referred to as discharge stroke region, and the range (denoted by Se in FIG. 7) on the swash plate 20 from the radial line R2 to the radial line RI concerning the rotational direction Q of the rotary shaft 18, is referred to as suction stroke region. The weight 201 is symmetrical with respect to the radial line R2. In this embodiment, only one inclination-limiting protuberance 191 is provided on the rotary support member 19, and is located in the discharge stroke region De as viewed in the axial direction of the rotary shaft 18. The state where the position-limiting surface of the inclination-limiting protuberance 191 comes into contact with the exposed peripheral surface 232 of the to-be-guided pin 23, is established whet the angle of inclination of the swash plate 20 becomes a maximum.

The second embodiment exhibits the following effects.

(2-1) When the piston. 26 in the cylinder bore 111 on the side of the discharge stroke region: De is in the discharge stroke, the compressive reaction acts upon the rotary support member 19 via the contact between the to-be-guided pin 23 and the inclination-limiting protuberance 191. The compressive reaction is exerted even when the angle of inclination of the swash plate 20 so increases that the to-be-guided pin 23 comes in contact with the inclination-limiting protuberance 191. The compressive reaction directly acts on the side of the discharge stroke region De. Therefore, the constitution, in which the inclination-limiting protuberance 191 is so arranged as to be included in the discharge stroke region De as viewed in the axial direction of the rotary shaft 18, is effective in efficiently receiving the compressive reaction by the rotary support member 19.

(2-2) When the inclination-limiting protuberance 191 exists on the side of the suction stroke region Se only, the moment of the compressive reaction increases with the inclination-limiting protuberance 191 on the side of the suction stroke region Se as a center, and an increased load is exerted on the portion where the to-be-guided pins 23, 24 are engaged with the guide, holes 251, 252. The increased load exerted on the above engaging portion impairs smooth relative movement between the to-be-guided pins 23, 24 and the guide holes 251, 252, and may hinder the motion of the swash plate 20 from the position of a maximum angle of inclination to the side of a minimum angle of inclination. The constitution, in which the inclination-limiting protuberance 191 is arranged on the side of the discharge stroke region De, decreases the moment of the compressive force with the inclination-limiting protuberance 191 as a center and eliminates the above-mentioned problem that occurs when the inclination-limiting protuberance 191 is arranged on the side of the suction stroke region Se only.

(2-3) The to-be-guided pins 23, 24 and the guide holes 251, 252 are brought into engagement at two places in the hinge mechanism. In the case of the first embodiment in which the inclination-limiting protuberances 191 and 192 are arranged in both the discharge stroke region De and in the suction stroke region Se, therefore, the rotary support member 19 will receive the compressive reaction at two places on the side of the support arm 25 and at two places on the side of the center of radius in the state where the swash plate 20 is inclined at its maximum angle. In this case, however, either one of the two inclination-limiting protuberances tends to be brought into contact with the to-be-guided pins 23 and 24. When the inclination-limiting protuberance 191 on the side of the discharge stroke region De comes into contact with the to-be-guided 23, the inclination-limiting protuberance 192 on the side of the suction stroke region Se no longer works. When the inclination-limiting protuberance 192 on the side of the suction stroke region Se comes into contact with the to-be-guided pin 24, the inclination-limiting protuberance 191 on the side of the discharge stroke region De no longer works, causing the problem that was described in (2-2) above. Therefore, the constitution in which the inclination-limiting protuberance 191 only is arranged on the side of the discharge stroke region De, is best suited for building up the structure, free from wear and wasteful operation, that can change the maximum angle of inclination of the swash plate 20.

Figure 8:
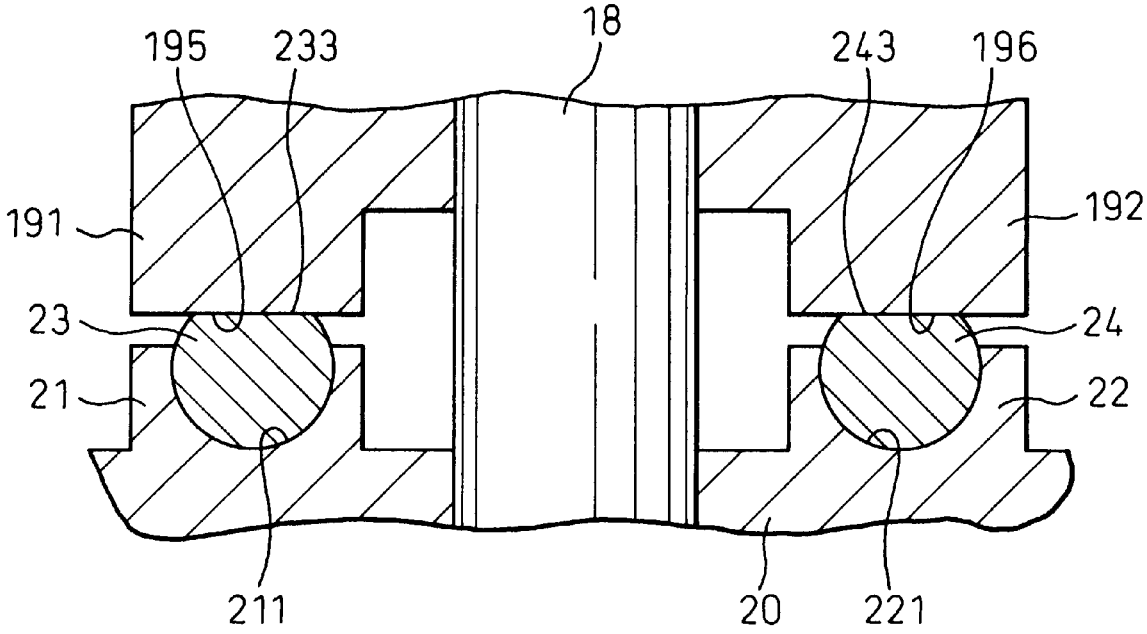
FIG. 8 is a side sectional view illustrating major portions of the compressor according to a third embodiment of the present invention.

Next, a third embodiment will be described with reference to FIG. 8. The same constituent portions as those of the first embodiment are denoted by the same reference numerals. The to-be-guided pins 23, 24 and the inclination-limiting protuberances 191, 192 come into plane contact with each other via contact planes 233, 243 on the side of the to-be-guided pins 23, 24 and via the plane position-limiting surfaces 195, 196 on the side of the inclination-limiting protuberances 191, 192. This embodiment exhibits the same effects as those of the first embodiment.

Figure 9:
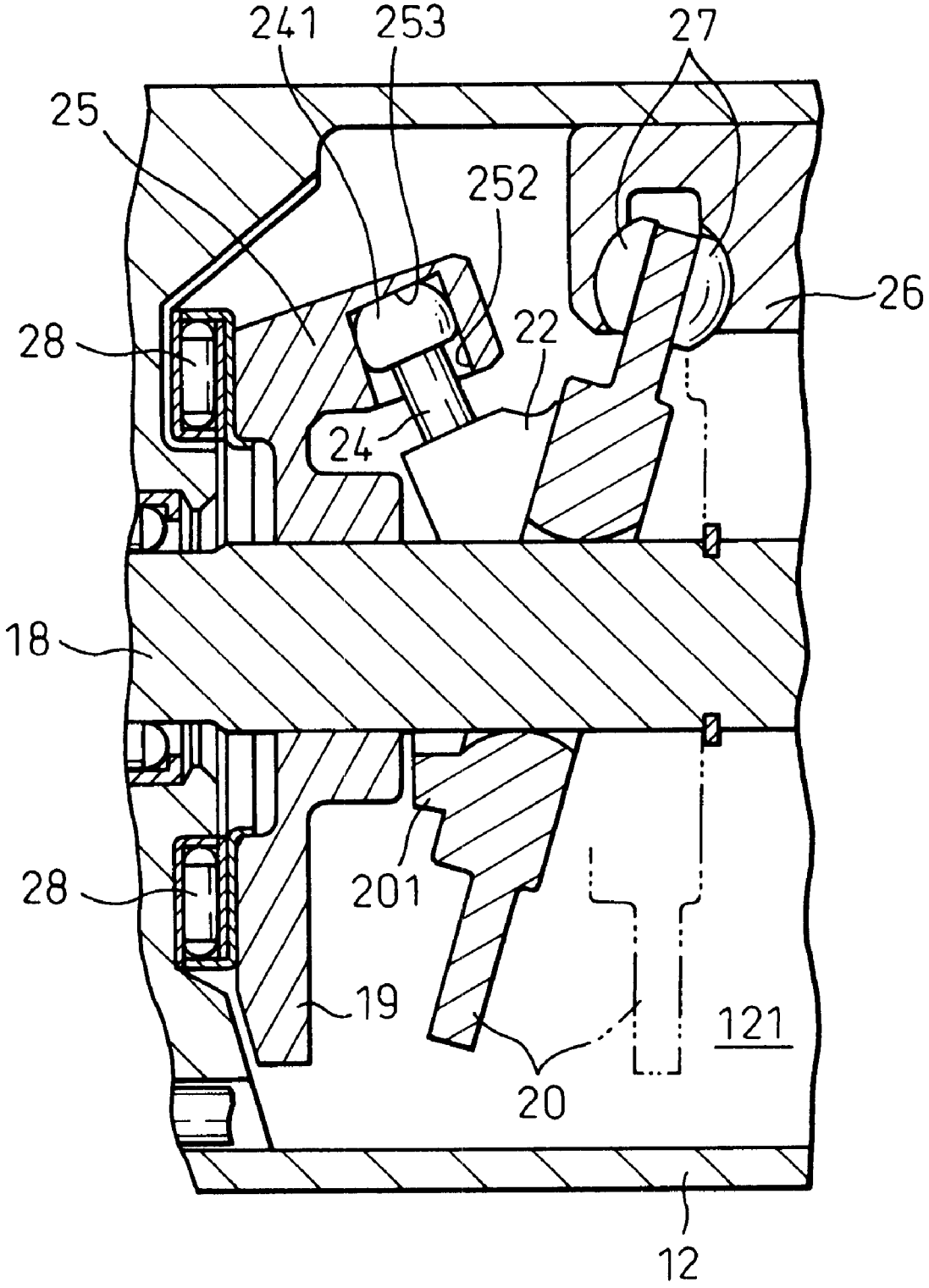
FIG. 9 is a side sectional view illustrating major portions of the compressor according to a fourth embodiment of the present invention.

Next, a fourth embodiment will be described with reference to FIG. 9. The same constituent portions as those of the first embodiment are denoted by the same reference numerals.

In this embodiment, a guide hole 252 (guide hole 251 is not shown) has a bottom 253, and the swash plate 20 is limited to a position of its maximum angle of inclination in a state where the head portion 241 of the to-be-guided pin 24 (to-be-guided pin 23 is not shown) is brought into contact with the bottom 253. The contact between the support arm 25 made of an iron-based material and the to-be-guided pin 24 made of an iron-based material, suppresses the wear at the contact portion.

Figure 10:
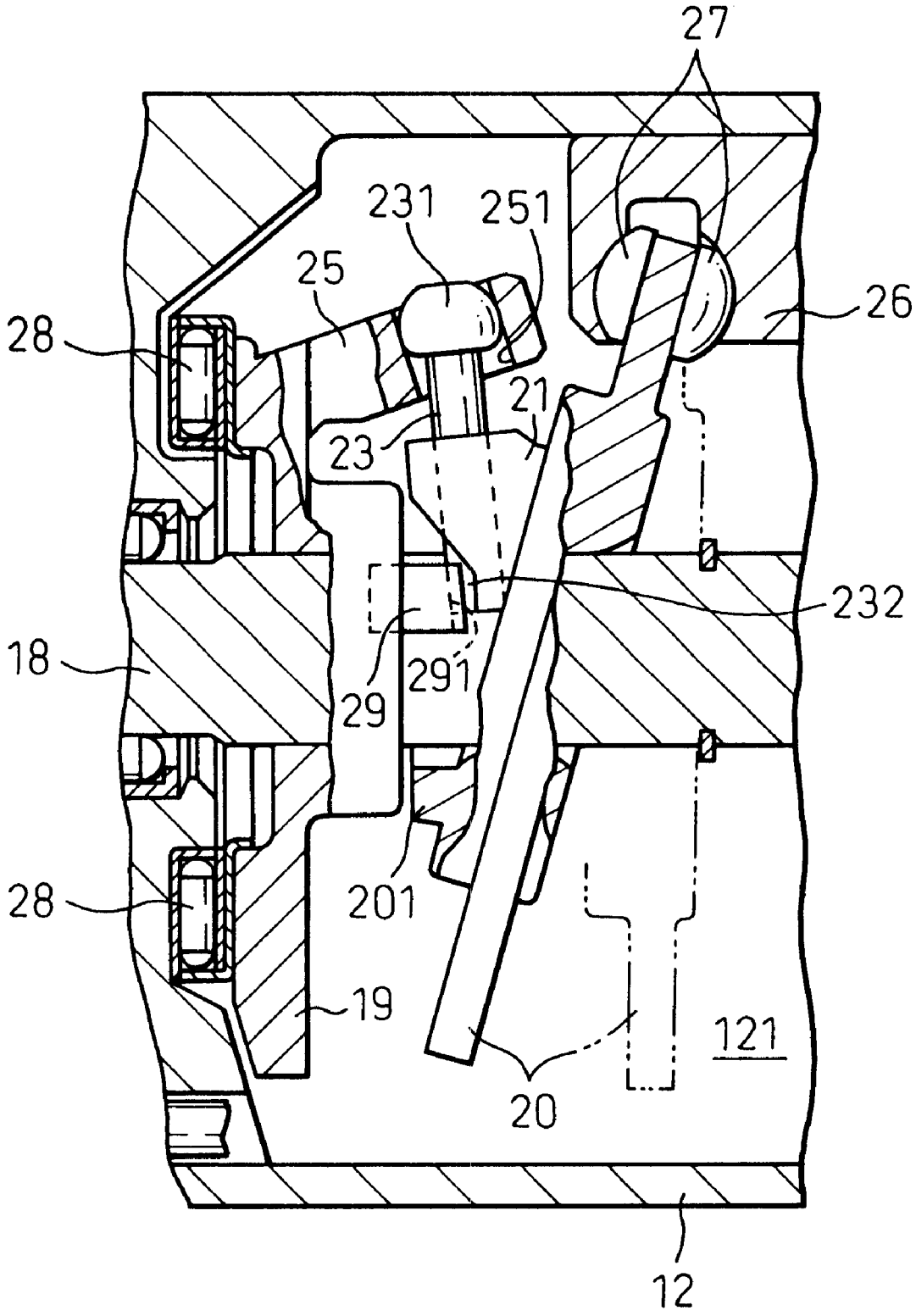
FIG. 10 is a side sectional view illustrating major portions of the compressor according to a fifth embodiment of the present invention.

Next, a fifth embodiment will be described with reference to FIG. 10. The same constituent portions as those of the second embodiment are denoted by the same reference numerals.

In this embodiment, the inclination-limiting member 29 made of an iron-based material is forcibly inserted in, and fastened to, the rotary support member 19 made of an aluminum-based material. The inclination-limiting member 29 is in the discharge stroke region as viewed in the axial direction of the rotary shaft 18. The shape of the position-limiting surface 291 at the end of the inclination-limiting member 29 is the same as the position-limiting surface 193 of the inclination-limiting protuberance 191 of the first embodiment, and the exposed peripheral surface 232 of the to-be-guided pin 23 comes into surface contact with the position-limiting surface 291.

This embodiment exhibits the same effects as those of the first and second embodiments as well as an effect of reducing the weight of the rotary support member 19. A reduction in the weight of the rotary support member. 19 brings about a reduction in the weight of the compressor.

Figure 11:
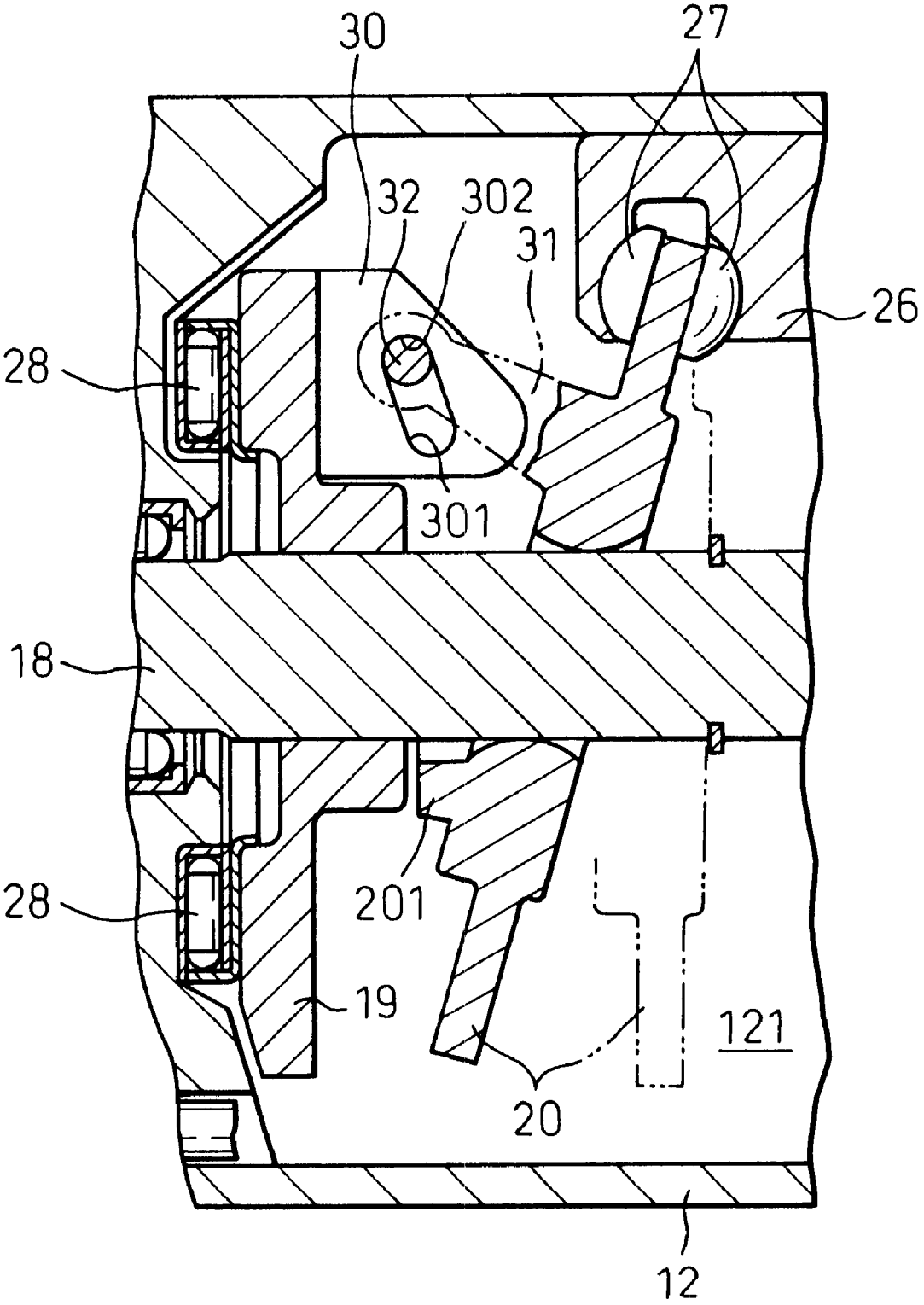
FIG. 11 is a side sectional view illustrating major portions of the compressor according to a sixth embodiment of the present invention.

Next, a sixth embodiment will be described with reference to FIG. 11. The constituent portions the same as those of the first embodiment are denoted by the same reference numerals.

The hinge mechanism according to this embodiment is the same as the one disclosed in Japanese Unexamined Patent Publications (Kokai) Nos. 10-246181 and 11-201032. A pair of support arms 30 (only one of them is shown) is integrally formed on the rotary support member 19 made of the iron-based material, and guide grooves 301 are formed in the support arms 30. To-be-guided pins 32 made of iron-based material are supported by a pair of coupling pieces 31 (only one of them is shown) integrally formed on the swash plate 20 made of the aluminum-based material. The to-be-guided pins 32 are slidably fitted into the guide grooves 301 in the pair of support arms 30. Due to the engagement between the pair of guide grooves 301 and the to-be-guided pins 32, the swash plate 20 is allowed to be inclined in the axial direction of the rotary shaft 18 and to rotate integrally with the rotary shaft 18. The inclination of the swash plate 20 is guided based upon a slide guide relationship between the guide grooves 301 and the to-be-guided pins 32 and upon the slide support action of the rotary shaft 18. The rotary support member 19, support arms 30 that work as passage-limiting cams, guide grooves 301 and to-be-guided pins 32 constitute a hinge mechanism for inclining the swash plate 20.

In the diagramed embodiment, the to-be-guided pins 32 are in contact with the upper ends 302 of the guide grooves 301, and the state of contact between the support arms 30 and the upper ends 302 of the to-be-guided pins 32 limit the swash plate 20 to the position of a maximum angle of inclination. The contact between the support arms 30 made of the iron-based material and the to-be-guided pins 32 made of the iron-based material, suppresses the wear at the contacting portion.

It is easy to specify the upper ends 302 of the guide grooves 301 to determine the maximum angle of inclination of the swash plate 20. That is, the design for determining a maximum angle of inclination of the swash plate 20 is facilitated by the constitution in which the angle of inclination of the swash plate is maximized depending upon the contacting state between the to-be-guided pins 32 made of the iron-based material and the upper ends 302 of guide grooves 301 in the support arms 30 which are portions of the rotary support member 19 made of the iron-based material.

Figure 12:
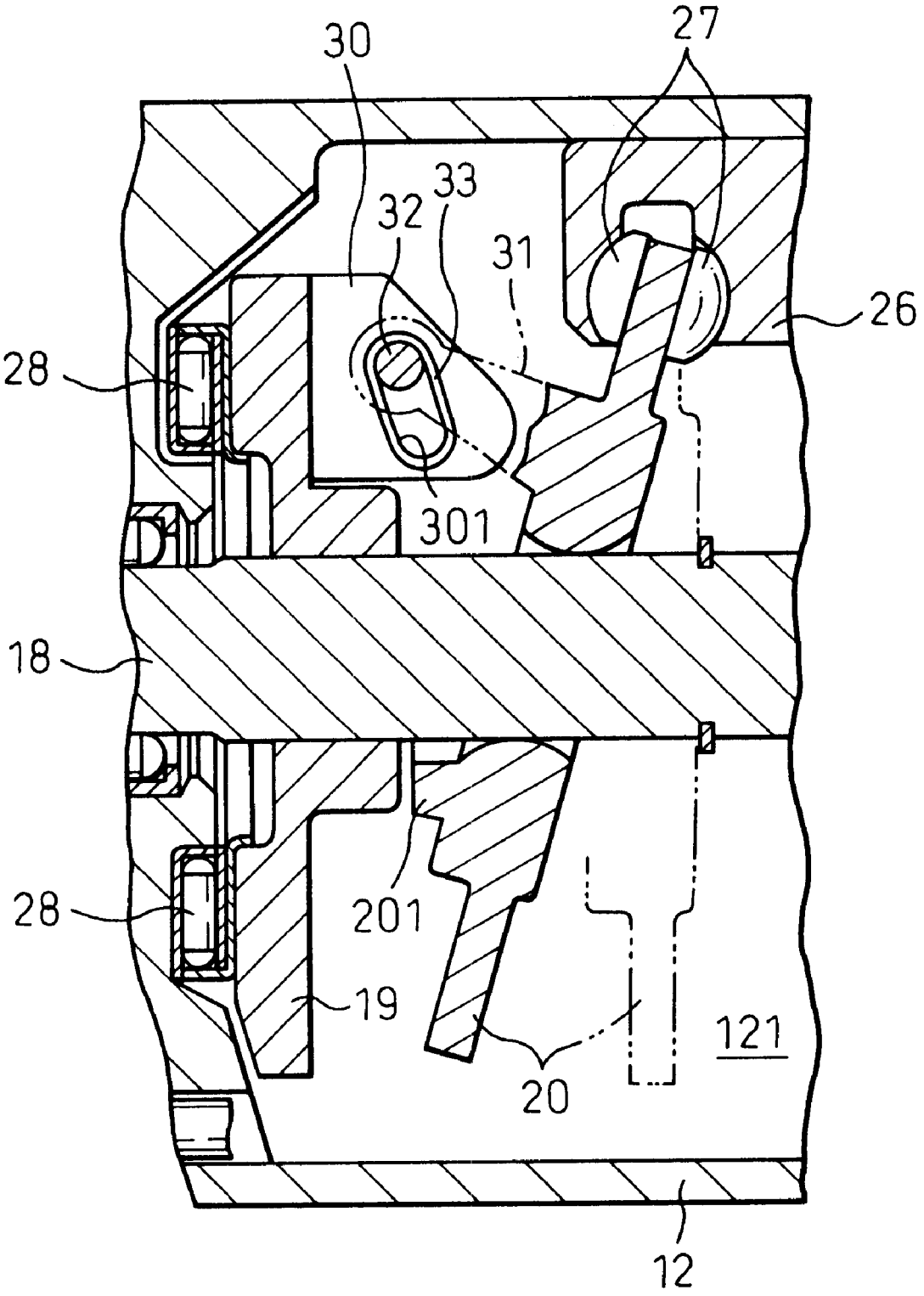
FIG. 12 is a side sectional view illustrating major portions of the compressor according to a seventh embodiment of the present invention.

Next, a seventh embodiment will be described with reference to FIG. 12. The same constituent portions as those of the sixth embodiment are denoted by the same reference numerals.

In this embodiment, the guide grooves 301 are formed by the passage-limiting cams 33 made of the iron-based material. The rotary support member 19 is made of the aluminum-based material. This embodiment exhibits the same effect as that of the fifth embodiment as well as the effect of reducing the weight of the rotary support member 19.

According to the present invention, it is also allowable to fasten guide pins, similar to the to-be-guided pins 23, 24, to the side of the rotary support member 19, and to provide the guide holes 251, 252 on the side of the swash plate 20.

It is further possible to provide the inclination-limiting protuberances on the side of the suction stroke region only.

According to the present invention as described above in detail the swash plate is placed at a position where the angle of inclination thereof becomes a maximum relying upon the contact between the guide member integrally formed with the rotary shaft and the to-be-guided member integral with the swash plate. Therefore, a maximum angle of inclination can be easily determined without causing a change in the maximum angle of inclination of the swash plate by wear.

While the invention has been described by reference to specific embodiments chosen for purposes of illustration, it should be apparent that numerous modifications could be made thereto by those skilled in the art without departing from the basic concept and scope of the invention.

We claim:

1. A variable-displacement compressor comprising a swash plate contained in a control pressure chamber so as to rotate integrally with a rotary shaft and to be inclined relative to the rotary shaft, plural pistons arranged about said rotary shaft and reciprocally moving depending upon the inclination of said swash plate, and swash plate inclination guide means for guiding the inclination of said swash plate, the pressure in said control pressure chamber being controlled to control the inclination of said swash plate;

wherein said swash plate inclination guide means includes a guide member having a passage-limiting cam, and to-be-guided members that are guided in sliding contact with the passage-limiting cam, said guide member is formed integrally with said rotary shaft, said to-be-guided members are formed integrally with said swash plate, and maximum inclination angle determining means is provided to determine said swash plate at a position where the angle of inclination of said swash plate becomes a maximum due to the contact of said guide member with said to-be-guided members.

2. A variable-displacement compressor according to claim 1, wherein said to-be-guided members are forcibly inserted in, and fastened to the support holes formed in said swash plate.

3. A variable-displacement compressor according to claim 2, wherein the positions for forcibly inserting said to-be-guided members are set between a position where said to-be-guided members come in contact with said passage-limiting cam and a position for determining a maximum angle of inclination of said swash plate.

4. A variable-displacement compressor according to claim 2, wherein open portions are formed by the sides of said support holes being continuous thereto, said to-be-guided portions are exposed through said open portions, and exposed portions of said to-be-guided portions exposed through said open portions come into contact with said guide member to determine a maximum angle of inclination of the swash plate.

5. A variable-displacement compressor according to claim 1, wherein said to-be-guided members are asymmetrically arranged in a pair, with said rotary shaft sandwiched therebetween, and in parallel with each other.

6. A variable-displacement compressor according to claim 5, wherein said maximum inclination-determining means is constituted to determine said swash plate at a position where the angle of inclination of said swash plate becomes a maximum relying upon a contact between one of said pair of to-be-guided members and said guide member.

7. A variable-displacement compressor according to claim 6, wherein one of said to-be-guided members that comes into contact with said guide member is in the discharge stroke region on said swash plate about said rotary shaft as viewed in the axial direction of said rotary shaft.

8. A variable-displacement compressor according to claim 4, wherein said exposed portions come into surface contact with said guide member.

9. A variable-displacement compressor according to claim 1, wherein said swash plate is made of an aluminum-based material, said guide member is made of an iron-based material, and said to-be-guided members are made of an iron-based material.

10. A variable-displacement compressor comprising a swash plate contained in a control pressure chamber so as to rotate integrally with a rotary shaft and to be inclined relative to the rotary shaft, plural pistons arranged about said rotary shaft and reciprocally moving depending upon the inclination of said swash plate, and a hinge mechanism for guiding the inclination of said swash plate, the pressure in said control pressure chamber being controlled to control the inclination of said swash plate;

wherein said hinge mechanism includes a guide pin formed integrally with said swash plate and a guide member, formed integrally with said rotary shaft, that guides said guide pin in a moving direction of said guide pin, and said swash plate is determined at a position where an angle of inclination of said swash plate becomes a maximum due to the contact of said guide pin with said guide member.

* * * * *